US010702750B1

(12) United States Patent
Wada et al.

(10) Patent No.: US 10,702,750 B1
(45) Date of Patent: Jul. 7, 2020

(54) GOLF CLUB HEAD

(71) Applicant: BRIDGESTONE SPORTS CO., LTD., Tokyo (JP)

(72) Inventors: Kozue Wada, Tokyo (JP); Tomonori Kitagawa, Tokyo (JP)

(73) Assignee: BRIDGESTONE SPORTS CO., LTD., Tokyo (JP)

( * ) Notice: Subject to any disclaimer, the term of this patent is extended or adjusted under 35 U.S.C. 154(b) by 0 days.

(21) Appl. No.: 16/592,991

(22) Filed: Oct. 4, 2019

(30) Foreign Application Priority Data

Dec. 12, 2018 (JP) ..... 2018-232870

(51) Int. Cl.
*A63B 53/04* (2015.01)

(52) U.S. Cl.
CPC .... *A63B 53/0466* (2013.01); *A63B 2053/045* (2013.01); *A63B 2053/0433* (2013.01)

(58) Field of Classification Search
CPC ..... A63B 2053/045; A63B 2053/0433
USPC ..... 473/324–350
See application file for complete search history.

(56) References Cited

U.S. PATENT DOCUMENTS 4,214,754 A * 7/1980 Zebelean ..... A63B 53/04 473/346
5,080,366 A * 1/1992 Okumoto ..... A63B 53/04 473/348
5,213,328 A * 5/1993 Long ..... A63B 53/04 473/346
5,460,376 A * 10/1995 Schmidt ..... A63B 53/04 473/328
5,603,668 A * 2/1997 Antonious ..... A63B 53/04 473/328
6,595,871 B2 * 7/2003 Sano ..... A63B 53/04 473/342
6,645,087 B2 * 11/2003 Yabu ..... A63B 53/00 473/342
6,681,612 B2 * 1/2004 Matsumoto ..... A63B 53/0466 72/352
6,852,038 B2 * 2/2005 Yabu ..... A63B 53/04 473/224
7,273,423 B2 * 9/2007 Imamoto ..... A63B 53/0466 473/332
7,396,298 B2 * 7/2008 Jertson ..... A63B 53/0466 473/345

(Continued)

FOREIGN PATENT DOCUMENTS

JP 04327864 A * 11/1992
JP 07163685 A * 6/1995 ..... A63B 53/0466

(Continued)

*Primary Examiner* — Alvin A Hunter
(74) *Attorney, Agent, or Firm* — IPUSA, PLLC

(57) ABSTRACT

A golf club head having a hollow structure includes a face, a crown, and a sole. The sole includes multiple elongated ribs. The ribs includes a first rib, a second rib, a third rib, and a fourth rib that are arranged in order from the toe side to the heel side. An end of the first rib and a first end of the second rib are connected to form a first connection end. A second end of the second rib and a first end of the third rib are connected to form a second connection end. A second end of the third rib and an end of the fourth rib are connected to form a third connection end. Each of the first rib and the fourth rib is longer than each of the second rib and the third rib.

10 Claims, 6 Drawing Sheets

(56) References Cited

U.S. PATENT DOCUMENTS

| | | | | |
|---|---|---|---|---|
| 7,500,924 | B2 * | 3/2009 | Yokota | A63B 53/0466 473/332 |
| 7,828,676 | B2 * | 11/2010 | Wada | A63B 53/0466 473/346 |
| 7,887,433 | B2 * | 2/2011 | Hoffman | A63B 53/0466 473/327 |
| 7,988,565 | B2 * | 8/2011 | Abe | A63B 53/0466 473/328 |
| 8,206,242 | B2 * | 6/2012 | Jertson | A63B 53/0466 473/332 |
| 8,226,500 | B2 * | 7/2012 | Yamamoto | A63B 53/0466 473/332 |
| 8,523,704 | B2 * | 9/2013 | Jertson | A63B 53/0466 473/332 |
| 8,727,910 | B2 | 5/2014 | Nakano | |
| 8,858,363 | B2 * | 10/2014 | Wada | A63B 53/0466 473/346 |
| 9,427,631 | B1 * | 8/2016 | Larson | A63B 53/0466 |
| 9,707,457 | B2 | 7/2017 | Mata et al. | |
| 9,925,430 | B2 * | 3/2018 | Stokke | A63B 53/0466 |
| 9,975,010 | B2 * | 5/2018 | Saso | A63B 53/0466 |
| 2003/0114244 | A1 * | 6/2003 | Matsunaga | A63B 53/0466 473/345 |
| 2004/0192463 | A1 | 9/2004 | Tsurumaki et al. | |
| 2005/0148405 | A1 * | 7/2005 | Imamoto | A63B 53/0466 473/338 |
| 2008/0045356 | A1 * | 2/2008 | Lin | A63B 53/0466 473/346 |
| 2008/0161125 | A1 * | 7/2008 | Jertson | A63B 53/0466 473/346 |
| 2010/0255931 | A1 * | 10/2010 | Ni | A63B 53/0466 473/346 |
| 2011/0287859 | A1 * | 11/2011 | Jertson | A63B 53/0466 473/346 |
| 2012/0129627 | A1 * | 5/2012 | Hirano | A63B 53/0466 473/346 |
| 2013/0157777 | A1 * | 6/2013 | Stokke | A63B 60/00 473/346 |
| 2014/0329616 | A1 * | 11/2014 | Stokke | A63B 53/0466 473/346 |
| 2015/0018123 | A1 * | 1/2015 | Cole | A63B 53/0466 473/346 |
| 2015/0094165 | A1 * | 4/2015 | Cole | A63B 53/0466 473/332 |
| 2015/0290503 | A1 * | 10/2015 | Su | A63B 53/0466 473/324 |
| 2016/0213985 | A1 * | 7/2016 | Jertson | A63B 53/0466 |
| 2016/0346647 | A1 * | 12/2016 | Stokke | A63B 53/0466 |
| 2017/0319919 | A1 * | 11/2017 | Cole | A63B 53/0466 |
| 2017/0333767 | A1 * | 11/2017 | Cole | A63B 53/0466 |
| 2018/0264330 | A1 * | 9/2018 | Kitagawa | A63B 53/0466 |

FOREIGN PATENT DOCUMENTS

| | | | | |
|---|---|---|---|---|
| JP | 09154984 | A * | 6/1997 | |
| JP | 2001095957 | A * | 4/2001 | |
| JP | 2001353240 | A * | 12/2001 | |
| JP | 2002126136 | A * | 5/2002 | A63B 53/00 |
| JP | 2003159354 | A * | 6/2003 | A63B 60/00 |
| JP | 4128970 | | 7/2008 | |
| JP | 4262369 | | 5/2009 | |
| JP | 2010029358 | A * | 2/2010 | A63B 53/0466 |
| JP | 2011062255 | A * | 3/2011 | |
| JP | 5095546 | | 12/2012 | |
| JP | 5107073 | | 12/2012 | |
| JP | 6346351 | | 6/2018 | |

* cited by examiner

GOLF CLUB HEAD

CROSS-REFERENCE TO RELATED APPLICATION

This application is based on and claims priority to Japanese patent application No. 2018-232870, filed on Dec. 12, 2018, the entire contents of which are incorporated herein by reference.

BACKGROUND OF THE INVENTION

1. Field of the Invention

The present invention relates to golf club heads.

2. Description of the Related Art

With respect to golf club heads, various techniques have been studied to improve the ball striking performance (for example, to achieve a ball trajectory advantageous for a flight distance). Such techniques for improving the ball striking performance include, for example, those described in Japanese Patent Nos. 5095546, 5107073, 4128970, 4262369 and 6346351 and U.S. Pat. No. 9,707,457. It is desired to give sufficient consideration to the crown side flexibility to improve the ball striking performance.

SUMMARY OF THE INVENTION

According to an aspect of the present invention, a golf club head having a hollow structure includes a face, a crown, and a sole. The sole includes multiple elongated ribs. The ribs includes a first rib, a second rib, a third rib, and a fourth rib that are arranged in order from the toe side to the heel side. An end of the first rib and a first end of the second rib are connected to form a first connection end. A second end of the second rib and a first end of the third rib are connected to form a second connection end. A second end of the third rib and an end of the fourth rib are connected to form a third connection end. Each of the first rib and the fourth rib is longer than each of the second rib and the third rib.

The object and advantages of the invention will be realized and attained by means of the elements and combinations particularly pointed out in the claims.

It is to be understood that both the foregoing general description and the following detailed description are exemplary and explanatory and not restrictive of the invention.

DETAILED DESCRIPTION OF EMBODIMENTS

Figure 1A:
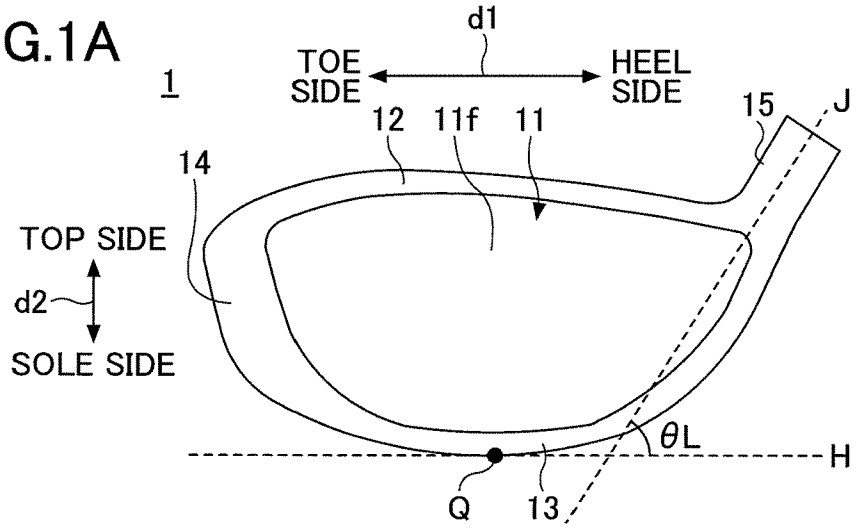
FIGS. 1A through 1D are diagrams illustrating a golf club head according to an embodiment.

It is desired to increase the sole side rigidity and improve the crown side flexibility of a golf club head.

According to an aspect of the present invention, a golf club head with increased sole side rigidity and improved crown side flexibility is provided.

Embodiments are described below with reference to the accompanying drawings. In the following description, the same elements are referred to using the same reference numeral, and duplicate description thereof may be omitted.

First Embodiment

FIGS. 1A, 1B, 1C and 1D are a front elevational view, a top plan (crown side) view, a left side (toe side) elevational view, and a right side (heel side) elevational view, respectively, of a golf club head 1 according to a first embodiment.

Figure 1B:
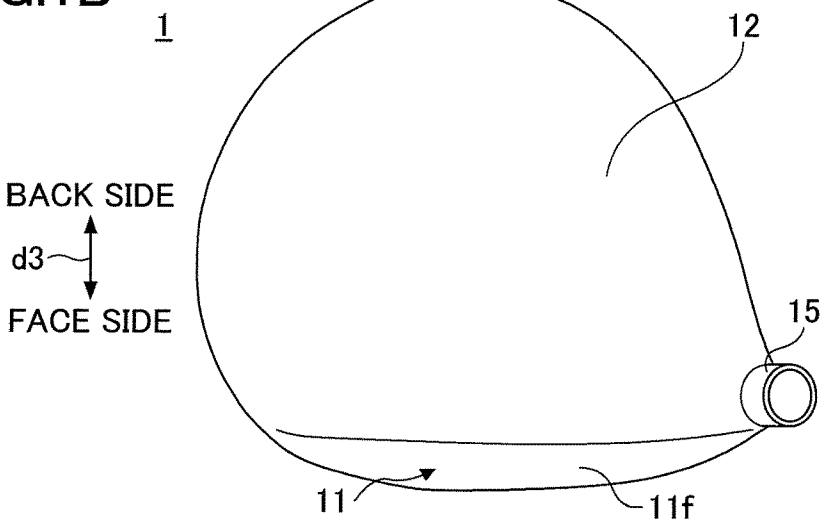
Figure 1C:
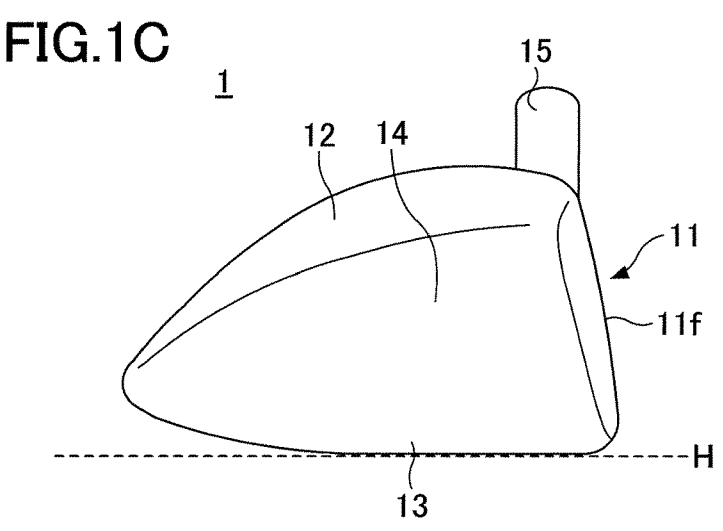
Figure 1D:
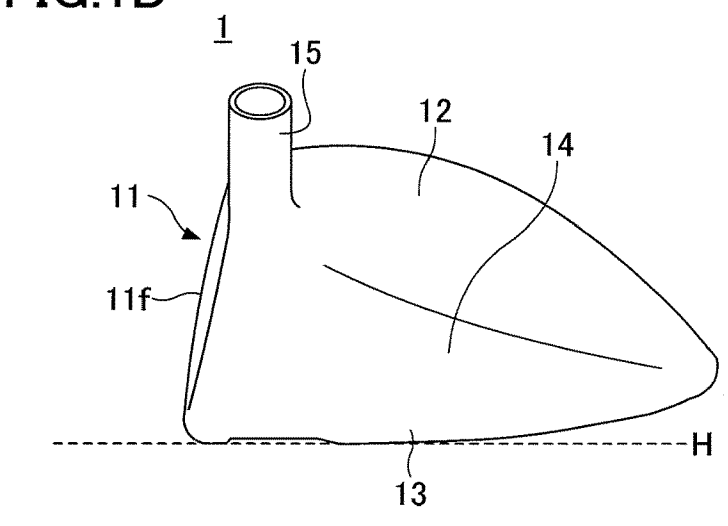

The front elevational view of FIG. 1A is a view taken from the side of a face surface 11*f* of the golf club head 1 (that is, a view looking at the face surface 11*f*), depicting the golf club head 1 resting (soled) on a horizontal plane H (corresponding to a ground surface) at a reference lie angle θL and a reference loft angle (not depicted). In FIG. 1A, the central axis of the bore of a hosel 15 is indicated by the dashed line J. In FIGS. 1A and 1B, the double-headed arrow d1 indicates the "toe-heel" (left-right) direction, namely, the direction from the toe side to the heel side or the direction from the heel side to the toe side, of the golf club head 1, the double-headed arrow d2 indicates the "top-sole" (up-down) direction, namely, the direction from the top side to the sole side or the direction from the sole side to the top side, of the golf club head 1, and the double-headed arrow d3 indicates the "face-back" (front-rear) direction, namely, the direction from the face side to the back side or the direction from the back side to the face side, of the golf club head 1.

The golf club head 1 depicted in FIGS. 1A through 1D is a wood-type golf club head such as a driver club head, but may also be a hybrid club head or a fairway wood club head.

The golf club head 1 may be made using, for example, titanium, a titanium alloy, stainless steel, aluminum, an aluminum alloy, a ferrous metal, magnesium, a magnesium alloy, a fiber reinforced resin, or the like. Multiple parts may be joined and assembled into the golf club head 1. The golf club head 1 is described in more detail below.

The golf club head 1 is a hollow structure that includes a face 11, a crown 12, a sole 13, a sidewall 14, and the hosel 15. An internal surface of the hollow structure may be referred to as "internal surface" and an external surface of the hollow structure may be referred to as "external surface."

The face 11 defines a front portion of the golf club head 1, and includes the face surface 11*f*, which defines a ball-striking surface between the crown 12 and the sole 13 in the top-sole direction. The face 11 has a predetermined thickness. The face surface lit forms an external surface of the face 11. The crown 12 defines a top portion of the golf club head 1. The sole 13 defines a bottom portion of the golf club head 1. The sidewall 14 extends between the crown 12 and the sole 13 to define a curved periphery of the golf club head 1 that is continuous with the face surface 11*f*. The hosel 15 receives a shaft.

In FIG. 1, a point Q indicates a point where the sole 13 contacts the horizontal plane H when the golf club head 1 is soled on the horizontal plane H at the reference lie angle θL and the reference loft angle.

FIGS. 2A through 2D are sectional views of the golf club head 1 soled on the horizontal plane H at the reference lie angle θL and the reference loft angle, illustrating a rib 50.

Figure 2A:
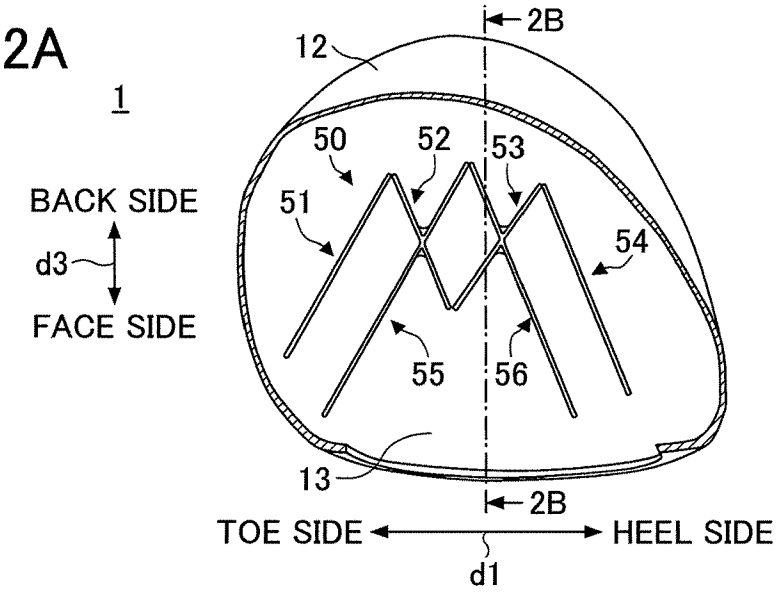
FIGS. 2A through 2D are diagrams illustrating a rib.
Figure 2B:
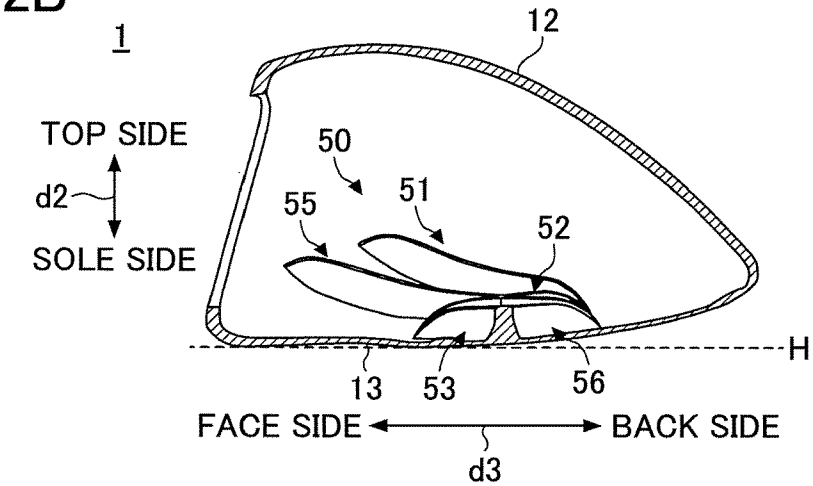

FIG. 2A is a transverse sectional view of the golf club head 1, looking at the sole side from the top side in a direction perpendicular to the horizontal plane H. FIG. 2B is a vertical sectional view of the golf club head 1 taken along the line 2B-2B of FIG. 2A, looking at the toe side from the heel side.

Figure 2C:
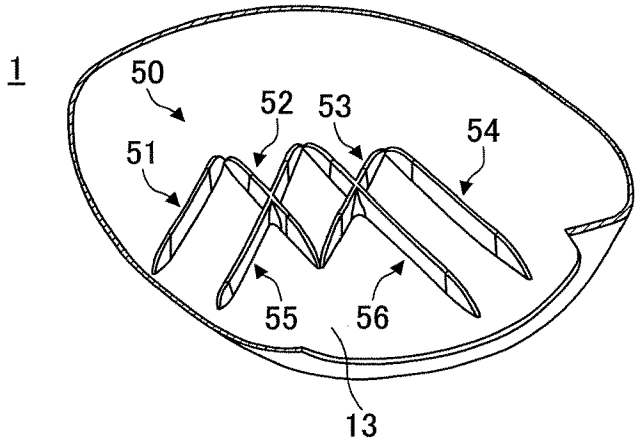
Figure 2D:
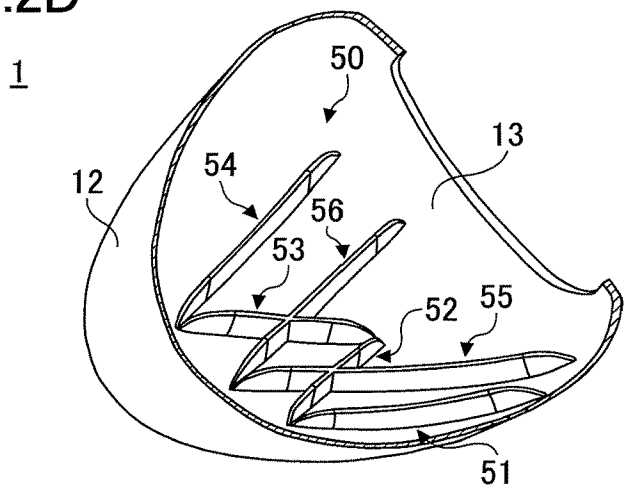

FIGS. 2C and 2D are transverse sectional views of the golf club head 1, looking at the sole side from the top side. While FIG. 2A is a view looking in a direction perpendicular to the horizontal plane H, FIGS. 2C and 2D are views looking in a direction oblique to the horizontal plane H.

Referring to FIGS. 2A through 2D, the sole 13 includes the rib 50. The rib 50 includes a first rib 51, a second rib 52, a third rib 53, a fourth rib 54, a first crossing rib 55, and a second crossing rib 56 formed in the internal surface of the sole 13.

Each rib of the rib 50 has an elongated shape having a length larger than a width, and protrudes substantially vertically from the internal surface of the sole 13 toward the crown 12. The rib 50 may further include other ribs.

Figure 3C:
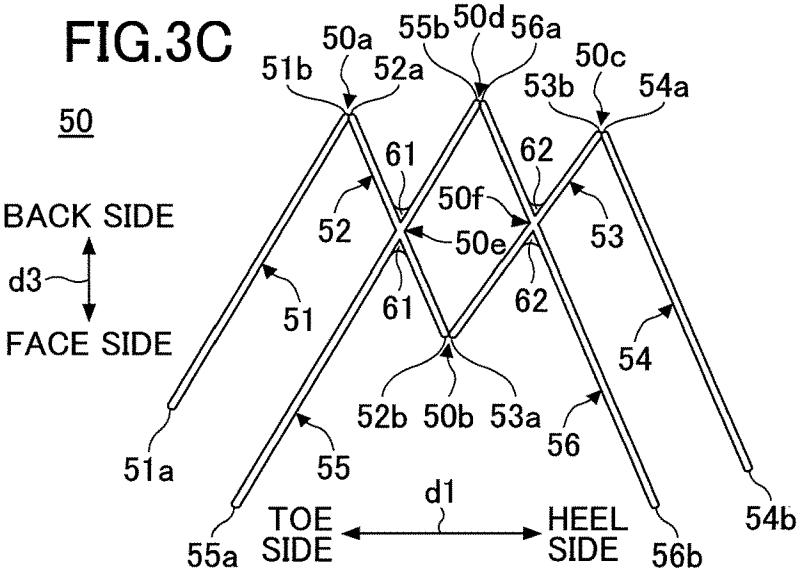
FIGS. 3A through 3D are diagrams illustrating the rib.
Figure 3D:
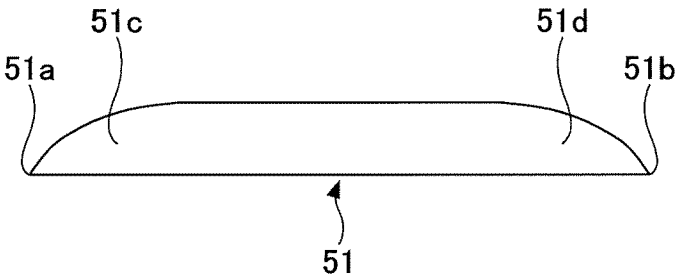
Figure 3A:
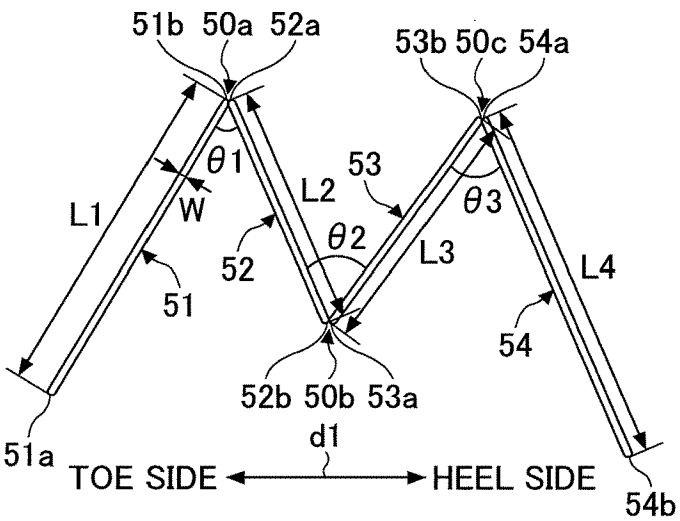
Figure 3B:
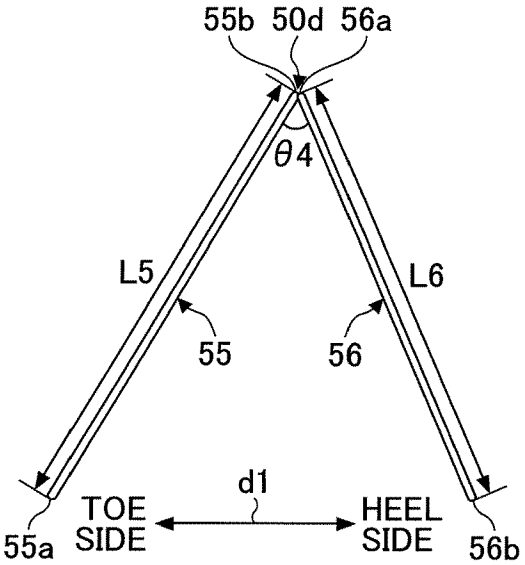

FIGS. 3A through 3C are diagrams illustrating the rib 50. FIG. 3A depicts the first rib 51, the second rib 52, the third rib 53, and the fourth rib 54 of FIG. 2A. FIG. 3B depicts the first crossing rib 55 and the second crossing rib 56 of FIG. 2A. FIG. 3C depicts the entirety of the rib 50 of FIG. 2A.

FIG. 3D is a side view of the first rib 51 of the rib 50. While the first rib 51 alone is depicted in FIG. 3D, the other ribs of the rib 50 have approximately the same shape as the first rib 51 in a side view.

Figure 4:
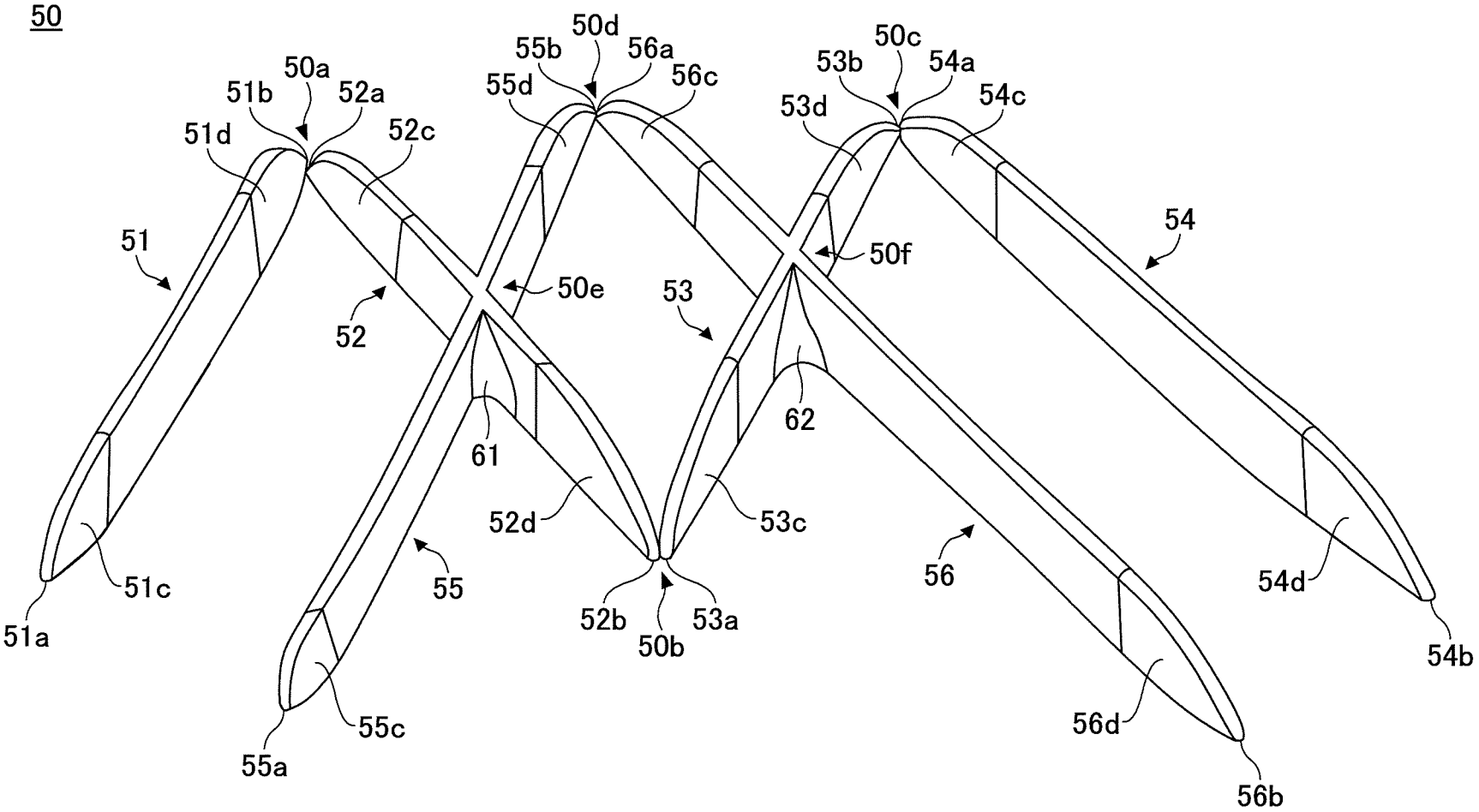
FIG. 4 is a diagram illustrating the rib.

FIG. 4 is an enlarged view of the entirety of the rib 50 of FIG. 2C, illustrating the rib 50.

Referring to FIG. 3A, the first rib 51, the second rib 52, the third rib 53, and the fourth rib 54 are arranged in order from the toe side to the heel side. That is, the first rib 51 is positioned closest to the toe among the ribs of the rib 50. The second rib 52 is positioned closer to the heel than the first rib 51. The third rib 53 is positioned closer to the heel than the second rib 52. The fourth rib 54 is positioned closer to the heel than the third rib 53.

The first rib 51 is a rectilinear rib extending from the face side to the back side with such inclination that a point closer to the back is closer to the heel. The second rib 52 is a rectilinear rib extending from the face side to the back side with such inclination that a point closer to the back is closer to the toe. The third rib 53 is a rectilinear rib extending from the face side to the back side with such inclination that a point closer to the back is closer to the heel. The fourth rib 54 is a rectilinear rib extending from the face side to the back side with such inclination that a point closer to the back is closer to the toe.

Referring to FIGS. 2A through 2D, 3A through 3D, and 4, a face-side end 51*a* of the first rib 51 is open. That is, the face-side end 51*a* of the first rib 51 is connected to no other ribs or the like. The first rib 51 includes a first sloping portion 51*c* whose height decreases toward the face-side end 51*a*. The first rib 51 further includes a second sloping portion 51*d* whose height decreases toward a back-side end 51*b* of the first rib 51. The second rib 52 includes a third sloping portion 52*c* whose height decreases toward a back-side end 52*a* of the second rib 52.

The back-side end 51*b*, which is the end of the second sloping portion 51*d* of the first rib 51, is connected to the back-side end 52*a*, which is the end of the third sloping portion 52*c* of the second rib 52, to form a first connection end 50*a*. That is, the back-side lower portion of the first rib 51 and the back-side lower portion of the second rib 52 are connected to form the first connection end 50*a*.

When viewed in a direction from the top side to the sole side, the first rib 51 and the second rib 52 form an angle θ1 at the first connection end 50*a*. The angle θ1 is preferably an acute angle. The angle θ1 is, for example, 30 degrees or more and 90 degrees or less.

The second rib 52 includes a fourth sloping portion 52*d* whose height decreases toward a face-side end 52*b* of the second rib 52. The third rib 53 includes a fifth sloping portion 53*c* whose height decreases toward a face-side end 53*a* of the third rib 53.

The face-side end 52*b*, which is the end of the fourth sloping portion 52*d* of the second rib 52, is connected to the face-side end 53*a*, which is the end of the fifth sloping portion 53*c* of the third rib 53, to form a second connection end 50*b*. That is, the face-side lower portion of the second rib 52 and the face-side lower portion of the third rib 53 are connected to form the second connection end 50*b*.

When viewed in a direction from the top side to the sole side, the second rib 52 and the third rib 53 form an angle θ2 at the second connection end 50*b*. The angle θ2 is preferably an acute angle. The angle θ2 is, for example, 30 degrees or more and 90 degrees or less.

The third rib 53 includes a sixth sloping portion 53*d* whose height decreases toward a back-side end 53*b* of the third rib 53. The fourth rib 54 includes a seventh sloping portion 54*c* whose height decreases toward a back-side end 54*a* of the fourth rib 54.

The back-side end 53*b*, which is the end of the sixth sloping portion 53*d* of the third rib 53, is connected to the back-side end 54*a*, which is the end of the seventh sloping portion 54*c* of the fourth rib 54, to form a third connection end 50*c*. That is, the back-side lower portion of the third rib 53 and the back-side lower portion of the fourth rib 54 are connected to form the third connection end 50*c*.

A face-side end 54*b* of the fourth rib 54 is open. That is, the face-side end 54*b* of the fourth rib 54 is connected to no other ribs or the like. The fourth rib 54 includes an eighth sloping portion 54*d* whose height decreases toward the face-side end 54*b*.

When viewed in a direction from the top side to the sole side, the third rib 53 and the fourth rib 54 form an angle θ3 at the third connection end 50*c*. The angle θ3 is preferably an acute angle. The angle 83 is, for example, 30 degrees or more and 90 degrees or less.

Thus, by connecting ribs at their respective lower portions at the ends of their respective sloping portions, it is possible to reduce the concentration of stress at the connection of the ribs.

The first rib 51, the second rib 52, the third rib 53, and the fourth rib 54 are arranged in an M-letter shape when viewed from the face side, for example. The first rib 51, the second rib 52, the third rib 53, and the fourth rib 54, however, may include a curving portion when viewed in a direction from the top side to the sole side (when viewed in the same direction as FIG. 3A).

A length L1 of the first rib 51 is, for example, 30 mm or more and 80 mm or less. A length L2 of the second rib 52 is, for example, 10 mm or more and 50 mm or less. A length L3 of the third rib 53 is, for example, 10 mm or more and 50 mm or less. A length L4 of the fourth rib 54 is, for example, 30 mm or more and 80 mm or less.

A width W of each of the first rib 51, the second rib 52, the third rib 53, and the fourth rib 54 is, for example, 0.5 mm or more and 3 mm or less.

Thus, according to the rib 50, each of the first rib 51 and the fourth rib 54 is longer than each of the second rib 52 and the third rib 53. This dimensional relationship makes it possible to dispose the first rib 51, the second rib 52, the third rib 53, and the fourth rib 54 over a wide area of the internal surface of the sole 13 and effectively increase the rigidity of the sole 13.

The first rib 51 and the third rib 53 are, for example, parallel. The second rib 52 and the fourth rib 54 are, for example, parallel. In this specification, being parallel includes being completely parallel and being substantially parallel. Ribs are said to be substantially parallel when the difference between the maximum value and the minimum value of the interval between the opposing side surfaces of the ribs is 5 mm or less.

Referring to FIG. 3B, the first crossing rib 55 and the second crossing rib 56 are arranged in order from the toe side to the heel side.

The first crossing rib 55 is a rectilinear rib extending from the face side to the back side with such inclination that a point closer to the back is closer to the heel. The second crossing rib 56 is a rectilinear rib extending from the face side to the back side with such inclination that a point closer to the back is closer to the toe.

Referring to FIGS. 2A through 2D, 3A through 3D, and 4, a face-side end 55*a* of the first crossing rib 55 is open. That is, the face-side end 55*a* of the first crossing rib 55 is connected to no other ribs or the like.

The first crossing rib 55 includes a ninth sloping portion 55*c* whose height decreases toward the face-side end 55*a*. The first crossing rib 55 further includes a tenth sloping portion 55*d* whose height decreases toward a back-side end 55*b* of the first crossing rib 55. The second crossing rib 56 includes an eleventh sloping portion 56*c* whose height decreases toward a back-side end 56*a* of the second crossing rib 56.

The back-side end 55*b*, which is the end of the tenth sloping portion 55*d* of the first crossing rib 55, is connected to the back-side end 56*a*, which is the end of the eleventh sloping portion 56*c* of the second crossing rib 56, to form a fourth connection end 50*d*. That is, the back-side lower portion of the first crossing rib 55 and the back-side lower portion of the second crossing rib 56 are connected to form the fourth connection end 50*d*.

A face-side end 56*b* of the second crossing rib 56 is open. That is, the face-side end 56*b* of the second crossing rib 56 is connected to no other ribs or the like. The second crossing rib 56 includes a twelfth sloping portion 56*d* whose height decreases toward the face-side end 56*b*.

When viewed in a direction from the top side to the sole side, the first crossing rib 55 and the second crossing rib 56 form an angle θ4 at the fourth connection end 50*d*. The angle θ4 is preferably an acute angle. The angle θ4 is, for example, 30 degrees or more and 90 degrees or less.

Thus, by connecting ribs at their respective lower portions at the ends of their respective sloping portions, it is possible to reduce the concentration of stress at the connection of the ribs.

The first crossing rib 55 and the second crossing rib 56 are arranged in an inverted V-letter shape (a V-letter shape open on the face side) when viewed from the face side, for example. The first crossing rib 55 and the second crossing rib 56, however, may include a curving portion when viewed in a direction from the top side to the sole side (when viewed in the same direction as FIG. 3A).

Each of the first crossing rib 55 and the second crossing rib 56 is, for example, longer than the first rib 51, the second rib 52, the third rib 53, and the fourth rib 54.

A length L5 of the first crossing rib 55 is, for example, 30 mm or more and 90 mm or less. A length L6 of the second crossing rib 56 is, for example, 30 mm or more and 90 mm or less.

The first crossing rib 55 and the second crossing rib 56 have the same width as the width W of each of the first rib 51, the second rib 52, the third rib 53, and the fourth rib 54.

The first crossing rib 55 crosses the second rib 52 at a first crossing 50*e*. The first crossing rib 55, for example, divides the second rib 52 into two approximately equal parts. That is, the length of the second rib 52 from the first crossing 50*e* to the back-side end 52*a* is approximately equal to the length of the second rib 52 from the first crossing 50*e* to the face-side end 52*b*.

The second crossing rib 56 crosses the third rib 53 at a second crossing 50*f*. The second crossing rib 56, for example, divides the third rib 53 into two approximately equal parts. That is, the length of the third rib 53 from the second crossing 50*f* to the back-side end 53*b* is approximately equal to the length of the third rib 53 from the second crossing 50*f* to the face-side end 53*a*.

The ribs of the rib 50 do not include a rib crossing, that is, do not cross each other at any part, other than the first crossing 50*e* and the second crossing 50*f*.

The fourth connection end 50*d* where the first crossing rib 55 and the second crossing rib 56 are connected is positioned on the back side of the second connection end 50*b*. The first rib 51 and the first crossing rib 55 are, for example, parallel. The fourth rib 54 and the second crossing rib 56 are, for example, parallel.

At the first crossing 50*e*, a first reinforcing part 61 is formed in a corner formed by a side surface of the second rib 52 and a side surface of the first crossing rib 55 in such a manner as to increase in width as it extends from the top side to the sole side.

As a non-limiting example, the first reinforcing part 61 may be formed, for example, at each of the opposing acute angles formed by the side surfaces of the second rib 52 and the side surfaces of the first crossing rib 55 at the first crossing 50*e*. The first reinforcing part 61 may be formed in at least one of the corners formed by the side surfaces of the second rib 52 and the side surfaces of the first crossing rib 55 on an as-needed basis.

At the second crossing 50*f*, a second reinforcing part 62 is formed in a corner foamed by a side surface of the third rib 53 and a side surface of the second crossing rib 56 in such a manner as to increase in width as it extends from the top side to the sole side.

As a non-limiting example, the second reinforcing part 62 may be formed, for example, at each of the opposing acute angles formed by the side surfaces of the third rib 53 and the side surfaces of the second crossing rib 56 at the second crossing 50*f*. The second reinforcing part 62 may be formed in at least one of the corners formed by the side surfaces of the third rib 53 and the side surfaces of the second crossing rib 56 on an as-needed basis.

Thus, by providing the first reinforcing part 61 and the second reinforcing part 62, it is possible to reduce the concentration of stress at the crossing of ribs and to increase the rigidity of the sole 13.

Figure 5:
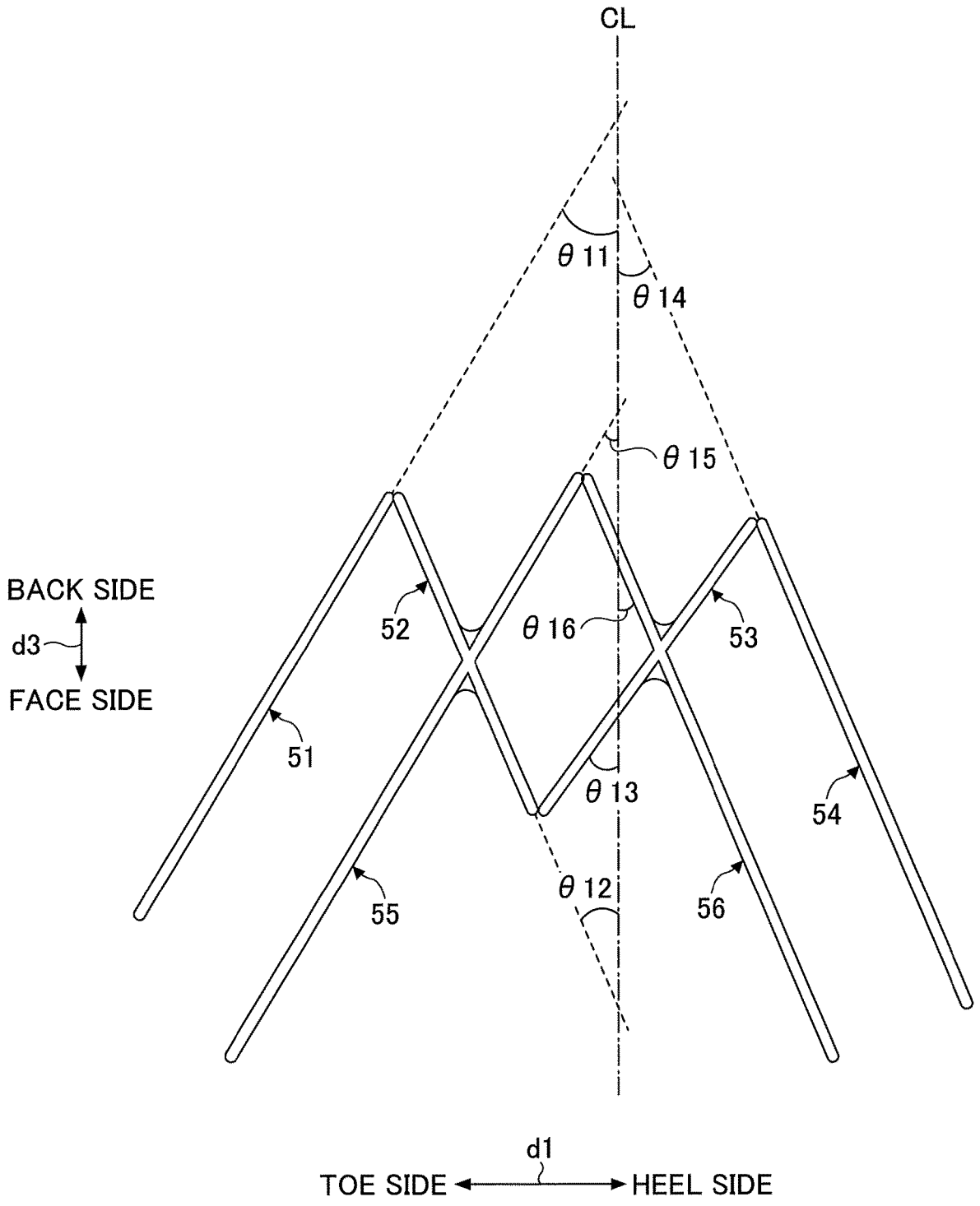
FIG. 5 is a diagram illustrating the rib.

FIG. 5 is a diagram illustrating the rib 50, depicting an example placement of the rib 50 relative to a face centerline. A face centerline CL illustrated in FIG. 5 is a line segment in a ball flight direction that passes through a point (the point Q in FIG. 1A) where the sole 13 contacts a horizontal plane when the golf club head 1 is soled on the horizontal plane at a reference lie angle and a reference loft angle.

An angle θ11 formed by the first rib 51 and the face centerline CL is, for example, 15 degrees or more and 60 degrees or less. An angle θ12 formed by the second rib 52 and the face centerline CL is, for example, 15 degrees or more and 60 degrees or less.

An angle θ13 formed by the third rib 53 and the face centerline CL is, for example, 15 degrees or more and 60 degrees or less. An angle θ14 formed by the fourth rib 54 and the face centerline CL is, for example, 15 degrees or more and 60 degrees or less.

An angle θ15 formed by the first crossing rib 55 and the face centerline CL is, for example, 15 degrees or more and 60 degrees or less. An angle θ16 formed by the second crossing rib 56 and the face centerline CL is, for example, 15 degrees or more and 60 degrees or less.

The above-described angular range of the angle θ11, the angle θ12, the angle θ13, the angle θ14, the angle θ15, and the angle θ16 makes it possible to place the rib 50 over a wide area of the internal surface of the sole 13 and effectively increase the rigidity of the sole 13.

Thus, according to the golf club head 1, the rib 50 includes the first rib 51, the second rib 52, the third rib 53, and the fourth rib 54 formed in the internal surface of the sole 13. The first rib 51, the second rib 52, the third rib 53, and the fourth rib 54 are arranged in order from the toe side to the heel side, and are connected in, for example, an M-letter shape. Each of the first rib 51 and the fourth rib 54 is longer than each of the second rib 52 and the third rib 53.

This makes it possible to dispose the first rib 51, the second rib 52, the third rib 53, and the fourth rib 54 over a wide area of the internal surface of the sole 13, and it is therefore possible to effectively increase the rigidity of the sole 13 and to selectively flex the crown 12 when striking a ball. Furthermore, by improving the flexibility of the crown 12, it is possible to achieve a ball trajectory of a high launch angle with low ball spin that is advantageous for a flight distance when making a shot.

Furthermore, because it is possible to increase the rigidity of the sole 13 over a wide area both in the toe-heel direction and in the face-back direction, it is possible to reduce the thickness of the sole 13. Excess weight produced by reduction in the thickness of the sole 13 may be allocated to a position advantageous for a function of the golf club head 1.

Furthermore, the rib 50 includes the first crossing rib 55 and the second crossing rib 56 in addition to the first rib 51, the second rib 52, the third rib 53, and the fourth rib 54. This makes it possible to further increase a rigidity increasing effect on the sole 13 and a flexibility improving effect on the crown 12. In addition, by further increasing the rigidity of the sole 13, it is possible to further reduce the thickness of the sole 13. Therefore, reduction in the thickness of the sole 13 produces more excess weight that may be allocated to a position advantageous for a function of the golf club head 1.

Second Embodiment

A second embodiment illustrates a rib that is different in shape from that of the first embodiment. In the second embodiment, a description of the same elements as those of the above-described embodiment may be omitted.

FIGS. 6A through 6D are sectional views of a golf club head 2 soled on the horizontal plane H at a reference lie angle and a reference loft angle.

Figure 6A:
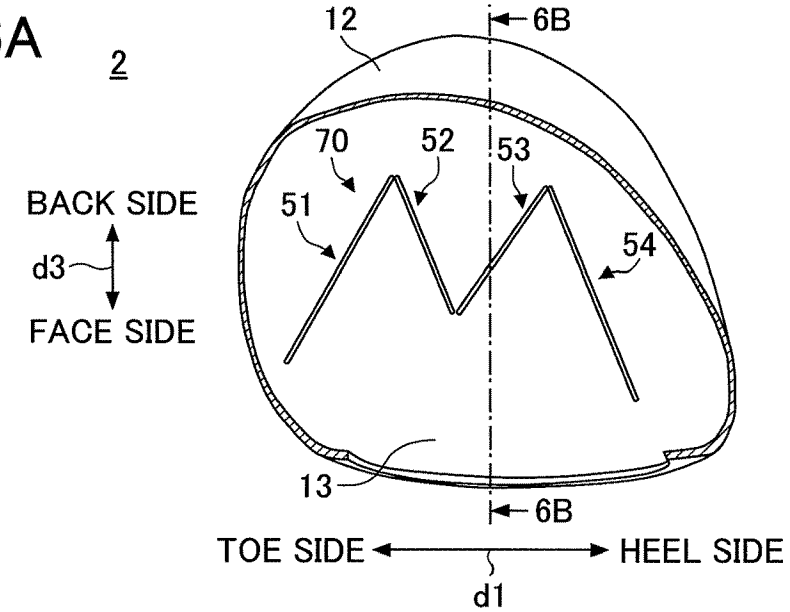
FIGS. 6A through 6D are diagrams illustrating a rib according to another embodiment.
Figure 6B:
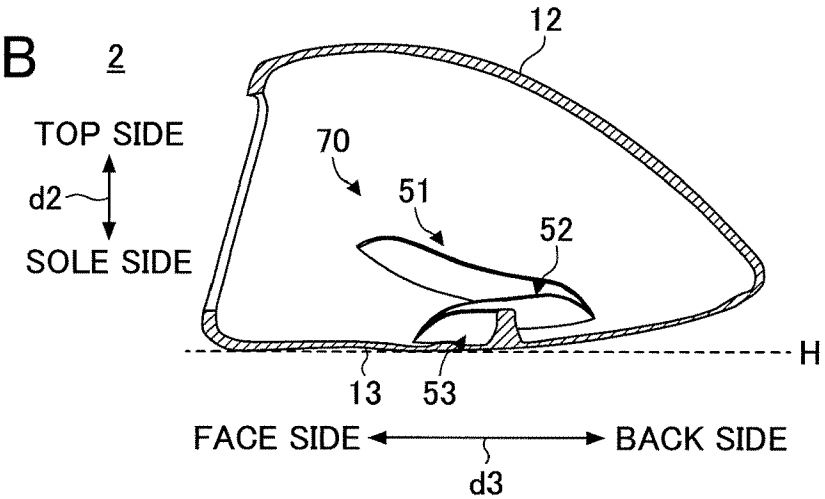

FIG. 6A is a transverse sectional view of the golf club head 2, looking at the sole side from the top side in a direction perpendicular to the horizontal plane H. FIG. 6B is a vertical sectional view of the golf club head 2 taken along the line 6B-6B of FIG. 6A, looking at the toe side from the heel side.

Figure 6C:
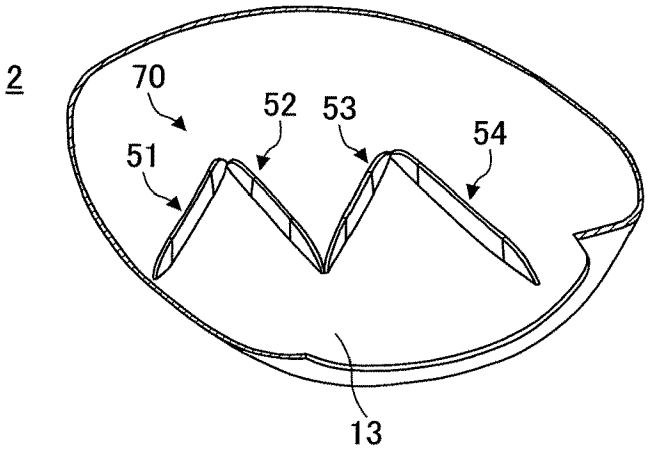
Figure 6D:
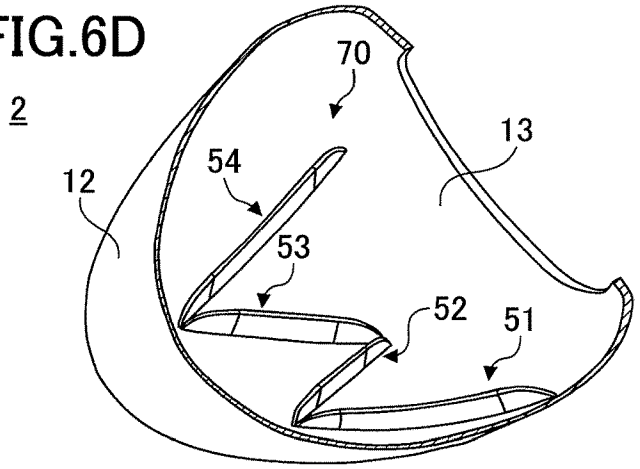

FIGS. 6C and 6D are transverse sectional views of the golf club head 2, looking at the sole side from the top side. While FIG. 6A is a view looking in a direction perpendicular to the horizontal plane H, FIGS. 6C and 6D are views looking in a direction oblique to the horizontal plane H.

Referring to FIGS. 6A through 6D, the golf club head 2 is different from the golf club head 1 (see, for example, FIGS. 2A through 2D) in that the sole 13 includes a rib 70 instead of the rib 50.

The rib 70 includes the first rib 51, the second rib 52, the third rib 53, and the fourth rib 54 formed in the internal surface of the sole 13. Unlike the rib 50, the rib 70 includes neither the first crossing rib 55 nor the second crossing rib 56.

That is, according to the rib 70, the first rib 51, the second rib 52, the third rib 53, and the fourth rib 54 are arranged in order from the toe side to the heel side, and are connected in, for example, an M-letter shape. Each of the first rib 51 and the fourth rib 54 is longer than each of the second rib 52 and the third rib 53.

Specific examples of the length, width, placement angle, etc., of the first rib 51, the second rib 52, the third rib 53, and the fourth rib 54 are the same as in the case of the rib 50.

Thus, depending on the required rigidity of the sole 13 and the specifications of the allocation of excess weight, the sole 13 may include the rib 70 that includes the first rib 51, the second rib 52, the third rib 53, and the fourth rib 54 and includes neither the first crossing rib 55 nor the second crossing rib 56.

In this case as well, the same effects as in the first embodiment are produced. That is, because it is possible to dispose the first rib 51, the second rib 52, the third rib 53, and the fourth rib 54 over a wide area of the internal surface of the sole 13, it is possible to effectively increase the rigidity of the sole 13 and to selectively flex the crown 12 when striking a ball. Furthermore, by improving the flexibility of the crown 12, it is possible to achieve a ball trajectory of a high launch angle with low ball spin that is advantageous for a flight distance when making a shot.

Furthermore, because it is possible to increase the rigidity of the sole 13 over a wide area both in the toe-heel direction and in the face-back direction, it is possible to reduce the thickness of the sole 13. Excess weight produced by reduction in the thickness of the sole 13 may be allocated to a position advantageous for a function of the golf club head 2.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

For example, while the above-described embodiments illustrate a case where the face-side end 51*a* of the first rib 51 and the face-side end 54*b* of the fourth rib 54 are open, the present invention is not limited to this. For example, one or both of the face-side end 51*a* of the first rib 51 and the face-side end 54*b* of the fourth rib 54 may be connected to part of the internal surface of the golf club head 1. Furthermore, one or both of the face-side end 51*a* of the first rib 51 and the face-side end 54*b* of the fourth rib 54 may be connected may be connected to another rib. The same is the case with the face-side end 55*a* of the first crossing rib 55 and the face-side end 56*b* of the second crossing rib 56.

What is claimed is:

1. A golf club head having a hollow structure, the golf club head comprising:

a face;

a crown; and a sole, the sole including a plurality of elongated ribs, the plurality of elongated ribs including a first rib, a second rib, a third rib, and a fourth rib that are arranged in order from a toe side to a heel side, wherein an end of the first rib and a first end of the second rib are connected to form a first connection end, a second end of the second rib and a first end of the third rib are connected to form a second connection end, a second end of the third rib and an end of the fourth rib are connected to form a third connection end, and each of the first rib and the fourth rib is longer than each of the second rib and the third rib.

2. The golf club head as claimed in claim 1, wherein the first rib includes a first sloping portion whose height decreases toward the first connection end, the second rib includes a second sloping portion whose height decreases toward the first connection end, and an end of the first sloping portion that is the end of the first rib and an end of the second sloping portion that is the first end of the second rib are connected to form the first connection end, the second rib includes a third sloping portion whose height decreases toward the second connection end, the third rib includes a fourth sloping portion whose height decreases toward the second connection end, and an end of the third sloping portion that is the second end of the second rib and an end of the fourth sloping portion that is the first end of the third rib are connected to form the second connection end, and the third rib includes a fifth sloping portion whose height decreases toward the third connection end, the fourth rib includes a sixth sloping portion whose height decreases toward the third connection end, and an end of the fifth sloping portion that is the second end of the third rib and an end of the sixth sloping portion that is the end of the fourth rib are connected to form the third connection end.

3. The golf club head as claimed in claim 1, wherein the first rib extends from a face side to a back side with such inclination that a point closer to the back side is closer to the heel side, and the fourth rib extends from the face side to the back side with such inclination that a point closer to the back side is closer to the toe side.

4. The golf club head as claimed in claim 1, wherein the first rib, the second rib, the third rib, and the fourth rib are rectilinear, the first rib and the third rib are parallel, and the second rib and the fourth rib are parallel.

5. The golf club head as claimed in claim 1, wherein the plurality of ribs further include a first crossing rib crossing the second rib at a first crossing; and a second crossing rib crossing the third rib at a second crossing.

6. The golf club head as claimed in claim 5, further comprising:

a first reinforcing part formed in a corner formed by a side surface of the second rib and a side surface of the first crossing rib at the first crossing, the first reinforcing part increasing in width as the first reinforcing part extends from a top side to a sole side; and a second reinforcing part formed in a corner formed by a side surface of the third rib and a side surface of the second crossing rib at the second crossing, the second reinforcing part increasing in width as the second reinforcing part extends from the top side to the sole side.

7. The golf club head as claimed in claim 5, wherein an end of the first crossing rib and an end of the second crossing rib are connected to form a fourth connection end, and the fourth connection end is positioned on a back side of the second connection end.

8. The golf club head as claimed in claim 5, wherein the plurality of ribs do not include a rib crossing other than the first crossing and the second crossing.

9. The golf club head as claimed in claim 5, wherein the first rib and the first crossing rib are parallel, and the fourth rib and the second crossing rib are parallel.

10. The golf club head as claimed in claim 1, wherein the first rib and the second rib form an acute angle at the first connection end, the second rib and the third rib form an acute angle at the second connection end, and the third rib and the fourth rib form an acute angle at the third connection end.

* * * * *